United States Patent [19]

Baggio et al.

[11] Patent Number: 4,765,069

[45] Date of Patent: Aug. 23, 1988

[54] DEVICE FOR CLOSING QUARTERS, PARTICULARLY FOR SKI BOOTS

[75] Inventors: Giorgio Baggio, S. Martino Di Lupari; Mariano Sartor, Montebelluna, both of Italy

[73] Assignee: Nordica S.p.A., Montebelluna, Italy

[21] Appl. No.: 9,161

[22] Filed: Jan. 30, 1987

[30] Foreign Application Priority Data

Feb. 6, 1986 [IT] Italy ..... 20871 B/86

[51] Int. Cl.[4] ..... A43C 11/00; A43B 5/04

[52] U.S. Cl. ..... 36/50; 36/117; 24/68 SK

[58] Field of Search ..... 36/117-121, 36/50; 24/68 SK

[56] References Cited

U.S. PATENT DOCUMENTS 4,408,403 10/1983 Martin ..... 36/50 X

FOREIGN PATENT DOCUMENTS 0188818 7/1986 European Pat. Off. ..... 36/119
3514657 11/1985 Fed. Rep. of Germany ..... 36/117
3506057 2/1986 Fed. Rep. of Germany ..... 36/117
3506056 3/1986 Fed. Rep. of Germany ..... 36/117
2475372 4/1981 France ..... 36/50
2572258 5/1986 France ..... 36/119
2577118 8/1986 France ..... 36/117

*Primary Examiner*—James Kee Chi
*Attorney, Agent, or Firm*—Guido Modiano; Albert Josif

[57] ABSTRACT

The device comprises a ratchet lever associated with the rear portion of the rear quarter, and coupled to a rack plate. The rack plate is longitudinally slideable on the quarter and engages with the mid-portion of a cable, connected at least one of its ends to the front quarter.

24 Claims, 3 Drawing Sheets

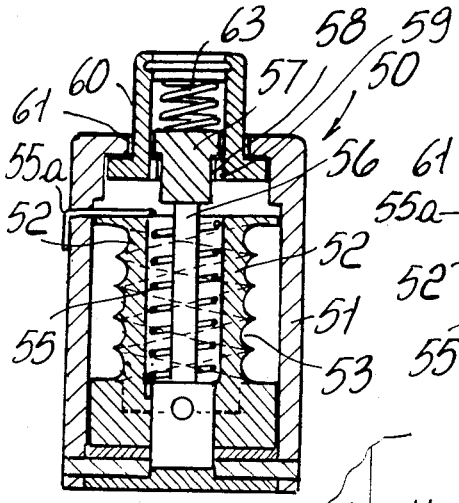
Fig. 9
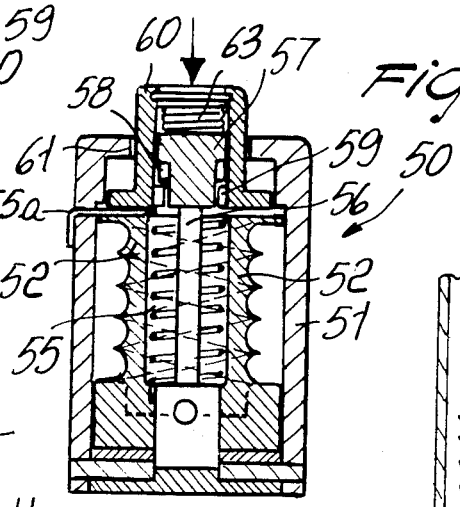
Fig. 10
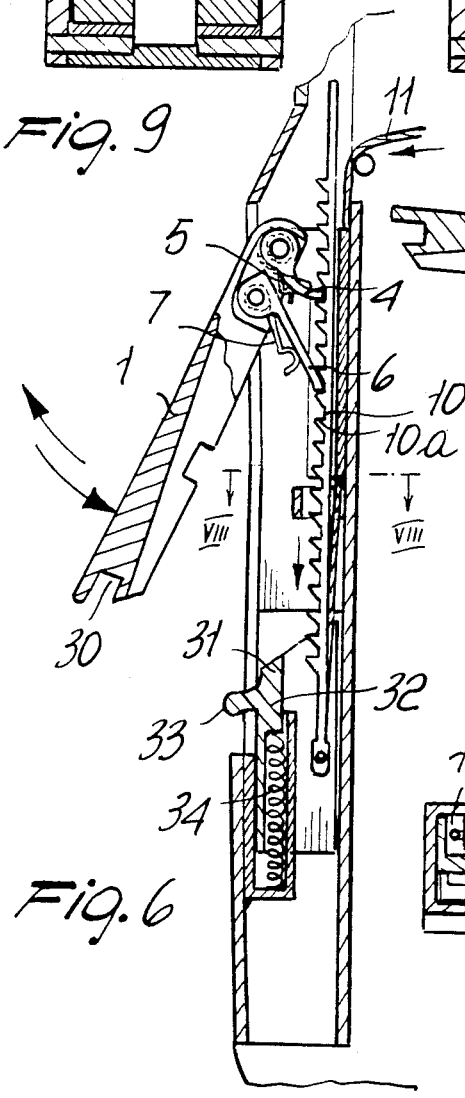
Fig. 6
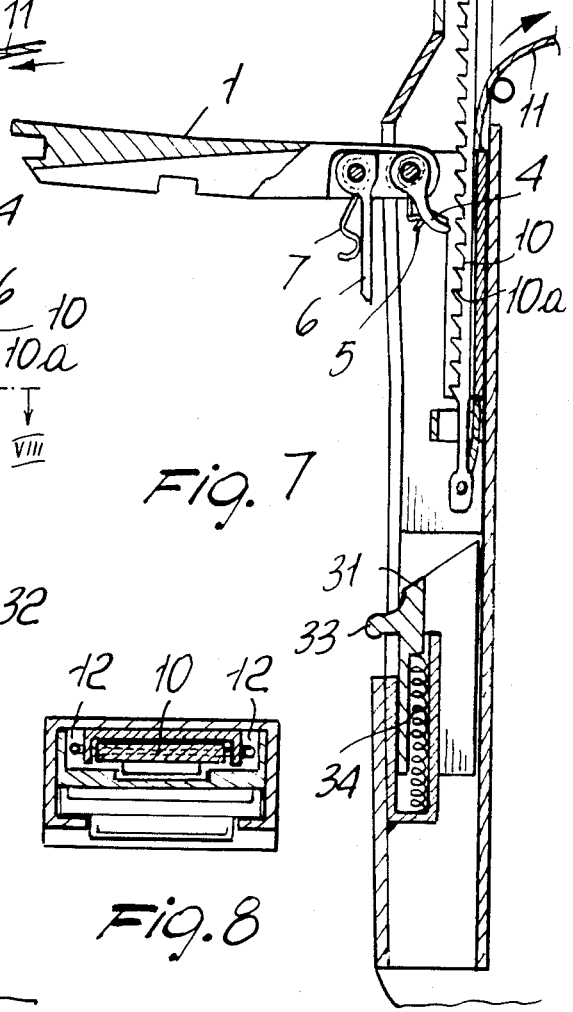
Fig. 7
Fig. 8

DEVICE FOR CLOSING QUARTERS, PARTICULARLY FOR SKI BOOTS

BACKGROUND OF THE INVENTION

The present invention relates to a device for closing quarters, particularly for rear-entry ski boots.

As is known, the closing of rear-entry ski boots is generally effected by means of levers arranged transversely with respect to the longitudinal extension of the quarters. The levers are composed of elements generally connected to the front quarter and rearwardly encircling the rear quarter.

These devices, however, give rise to laterally protruding projections which, besides being annoying for the user, may also be subject to accidental blows which might give rise to an unwanted opening thereof.

Another disadvantage resides in the fact that, generally, two separate levers must be used and moved individually and adjusted progressively in order to obtain a satisfactory closure.

SUMMARY OF THE INVENTION

The aim proposed by the invention is indeed to eliminate the above described disadvantages, by providing a device for closing quarters, particularly for rear-entry ski boots, which allows the possibility of having a single operating lever capable of achieving a secure closure of the boot, while avoiding a separation of the elements which compose the same device, so that the user, in the subsequent closing action, need not bring together beforehand the various component elements.

Still another object of the present invention is to provide a closing device which allows the user the possibility of performing quickly and simply the adjustment of the desired securing action, without having to perform subsequent reopenings and adjustments, since the desired securing action can be obtained with continuity.

A further object of the present invention is to provide a closing device which can be obtained with a limited number of component elements which are easy and quick to assemble together.

Not least object of the present invention is to provide a device for closing quarters, particularly for rear-entry ski boots, which, besides giving the greatest assurances of reliability and safety in use, is competitive from a purely economic point of view.

The above described aim, as well as the objects mentioned and others which will become apparent hereinafter, are achieved by a device for closing quarters, particularly for rear-entry ski boots, according to the invention, characterized in that it comprises a ratchet lever associated to one of the quarters and coupled to a rack plate which is longitudinally slideable on said one of said quarters, said rack plate engaging with a mid-portion of a cable connected, at least at one end thereof, to the other of said quarters.

BRIEF DESCRIPTION OF THE DRAWINGS

Further characteristics and advantages of the present invention will become apparent from the detailed description of a device for closing quarters, particularly for rear-entry ski boots, illustrated only by way of non-limitative example in the accompanying drawings, wherein:

FIG. 3 is a schematic front view of the device with a cable rewinding assembly;

FIG. 6 is a schematic longitudinal cross section view of the ratchet lever during operation;

FIG. 7 is a cross section view of the ratchet lever in uncoupled position;

FIG. 8 is a cross section view taken along the line VII—VII of FIG. 6;

FIGS. 9 and 10 are cross section views of the cable rewinding assembly.

DESCRIPTION OF THE PREFERRED EMBODIMENTS

Figures 1, 2:
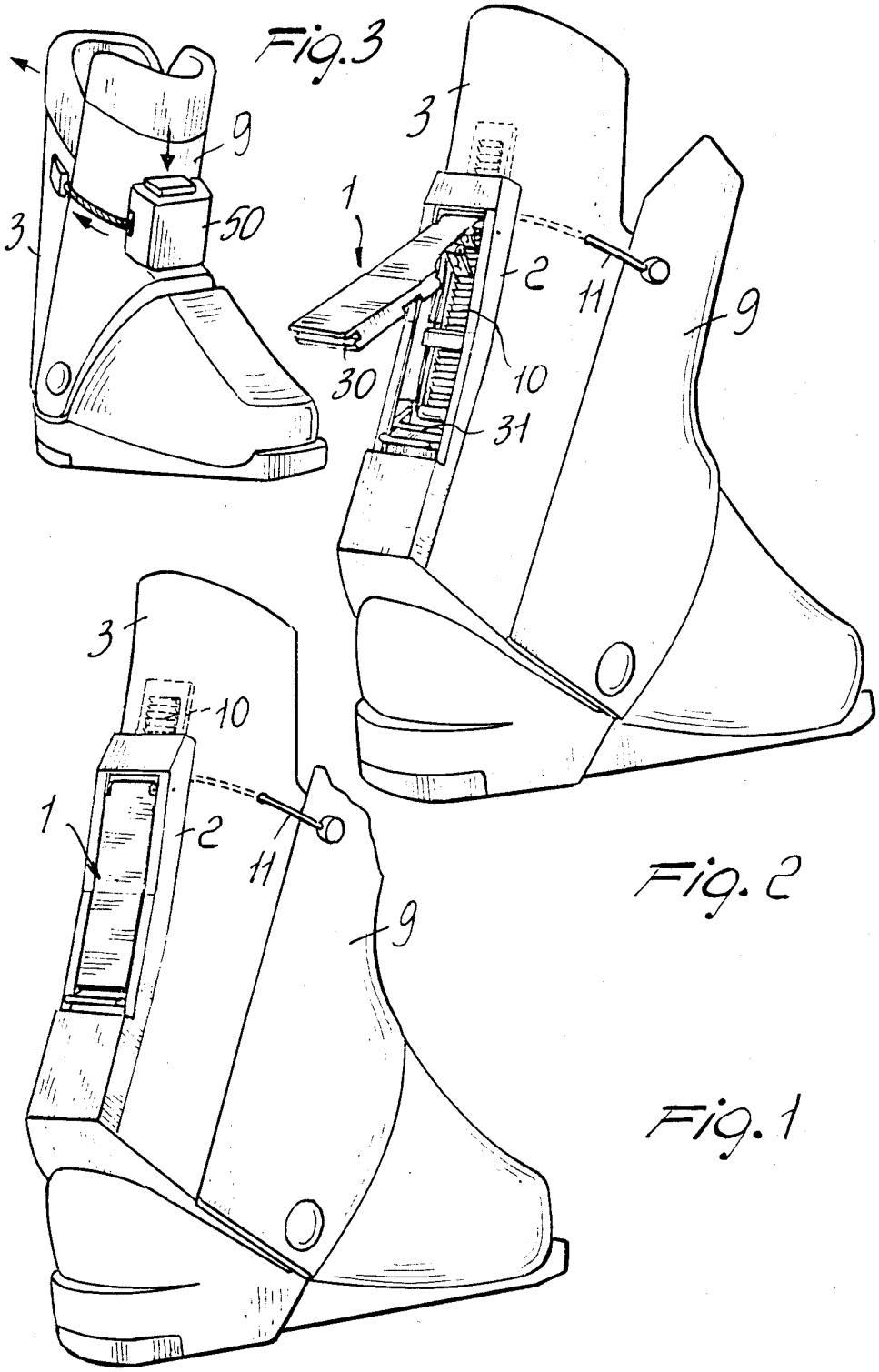
FIG. 1 is a perspective view of the closing device applied to a skit boot, in closed position.
FIG. 2 is a view of the closing device applied to a ski boot, in open position.

With reference to the above described figures, the device for closing quarters, particularly for rear-entry ski boots, according to the invention, comprises a ratchet lever of a per se known kind, which is generally indicated with the reference numeral 1, and is hinged to a small base 2 with the possibility of oscillating about an axis which is substantially perpendicular to the longitudinal extension of the rear quarter 3, to which it is applied, and is substantially perpendicular to the longitudinal extension of the base of the boot.

A peculiarity of the invention resides in the fact that said ratchet lever couples with a rack plate, indicated by the reference numeral 10, which is slideable between the hingeing head of the same lever and the small base 2, along a direction which is substantially longitudinal with respect to the extension of the quarter 3.

The ratchet lever 1, as is illustrated in FIGS. 6 and 7, is provided, on the face which is hidden from view in the closed position, with a pawl device constituted by a retention lever 4 pushed by a first torsion spring 5, which couples with the saw-teeth 10*a* of the rack 10. A pusher lever 6 is provided, spaced apart from the hingeing point of the lever 4 which is preferably pivoted on the axis of rotation of the lever 1, and is pushed by a second torsion spring 7 which is intended to engage with the abutment projection of the teeth 10*a* to exert the pushing action, when an alternate oscillation is compared to the lever 1, which in practice causes the consecutive motion of the rack 10.

As is illustrated in FIG. 7, the complete opening of the lever 1 achieves the uncoupling of the retention lever 4, so that the rack 10 can slide freely, since it is no longer retained.

At one end of the rack plate 10, and precisely at the lower end, the mid-portion of a cable 11 is connected which extends laterally from the rack plate 10 and which is slideably accommodated in guiding channels 12 which are defined either on the rear quarter 3 or in the box-like body composing the lever 1. The cable 11 is provided, at its free ends, with a fixed point on a lateral part of the front quarter indicated with the reference numeral 9.

Figure 4:
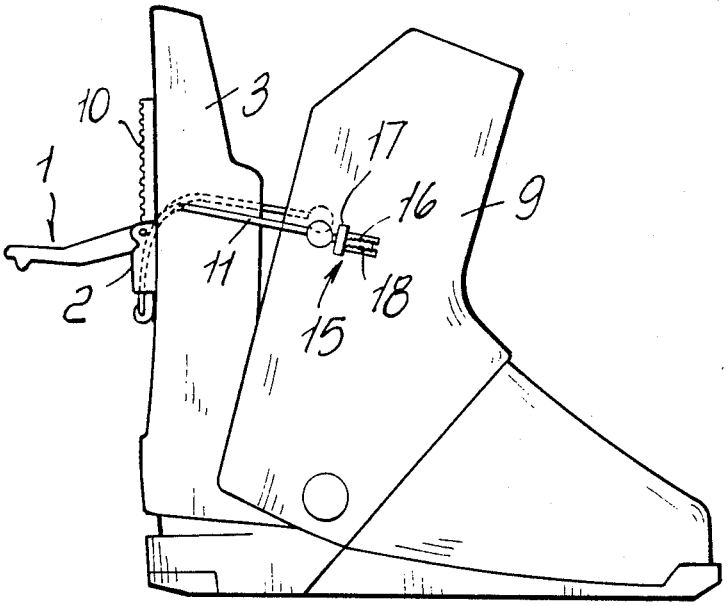
FIG. 4 is a lateral elevation view of the device, with means for adjusting its length, applied to a ski boot, in open position.
Figure 5:
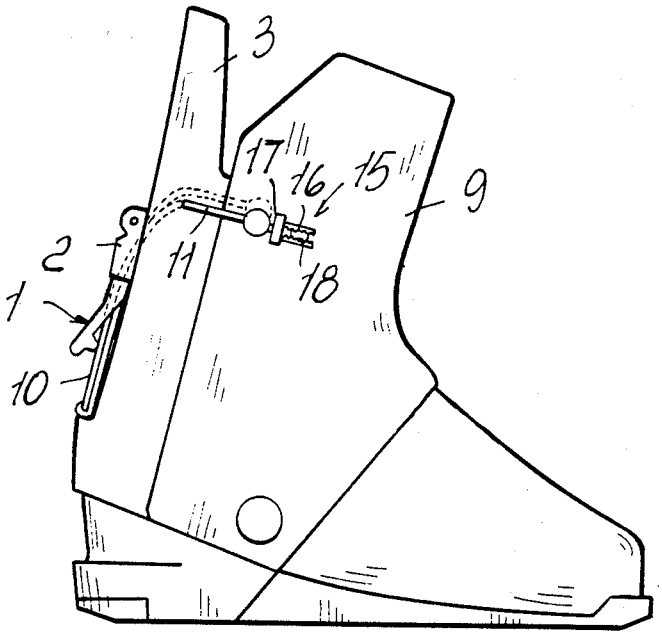
FIG. 5 is a view of the device of FIG. 4, in closed position.

Advantageously, but not necessarily, at one fixing end of the cable 11, as is illustrated in FIGS. 4 and 5, means are provided for adjusting the useful length of the cable itself, generally indicated with the reference numeral 15, which are advantageously realized by means of a threaded bush 16 connected to an operating ring 17 which can be accessed from the outside of the boot.

A threaded pawl 18, which is connected to the end of the cable 11, engages with the internal thread of the threaded bush 16.

In order to perform the closure of the boot, it is sufficient to perform an alternate oscillating motion of the ratchet lever 1 to achieve a downward thrust of the rack plate 10, which in practice tightens the cable 11 and brings towards each other and reciprocally secures together the rear quarter and the front quarter.

With the above-described arrangement, that is, with the cable arranged at both sides of the rack plate 10, upon translation of a portion of the rack plate 10, a corresponding double-variation of the useful working length of the cable 11 is obtained.

As is illustrated in FIGS. 6 and 7, in order to allow a quick release of the device, the lever 1 is provided, at its free end, with a slot 30 which can be coupled in a snap-together manner with a coupling tooth 31 of a button 32 supported by the rear part of the quarter and provided with a fin 33 which is easily accessible and can be operated, if required, directly with the point of a ski-stick.

As is illustrated in FIG. 1, in closed position the coupling tooth 31 couples in a snap-together manner with the slot 30, keeping the lever 1 secured closed to the rear quarter.

When release or uncoupling is required, it is sufficient to exert a pressing action on the fin 33, overcoming the elastic biasing force exerted by the spring 34 which pushes the button 32, thus performing the uncoupling of the coupling tooth 31 from the slot 30; in this condition, the springs which act on the levers 4 and 6 for operating the rack plate create a thrust in the direction of the opening of the lever 1.

In many cases, there also is the need to allow a sufficient opening of the boot in order to facilitate the entry of the foot; for this purpose, in order to avoid the requirement of a repeated actuation of the lever 1, in order to achieve rewinding of a significant length of cable, a rewinding assembly is provided on the boot, which rewinding assembly is indicated by the reference numeral 50 in FIG. 3 and, illustrated in cross section, in FIGS. 9 and 10, which is substantially composed of a box-like body 51 associated, e.g., with the front quarter.

Inside the outer box-like body 51, a spool 52 is rotatably provided, having grooves 53 for winding thereon the cable. A rewinding spring 55 acts on the spool 52, which spring has a fixed point **55*a*** on the outer containment body and is connected to the spool, so that the spring itself is reloaded during the unwinding of the spool and has the function of rewinding the cable for a certain length, until the elastic energy of the spring is no longer sufficiently opposed by the tension of the cable.

The spool 52 is provided with a central pivot 56 which ends upwardly with an expansion 57 provided with a dentallation 58 which can be coupled with a dentellation 59 defined on a button 60 shaped so as to be prevented from rotating with respect to the box-like body 51, in practice the button 60 can simply be provided with a polygonal shape and protrude from a matching polygonal hole 61 defined by the box-like body.

The button 60 can be moved against the biasing action to a biasing spring 63 which acts between the button itself and the expansion 57. The motion of the button uncouples the dentellations 58 and 59 from each other, thus allowing the free rotation of the spool, while, by releasing the button, the coupling between the dentellations blocks the rotation of the spool.

Thus during the opening of the quarter it is possible, after having provided the uncoupling of the lever 1, to act on the button 60 and move the quarters apart, thus achieving a remarkable opening of the same quarters.

In order to close the quarters, one acts, first of all, on the button 60 which, once the quarters are close together, recovers most of the cable, then, in order to perform the securing, one acts on the ratchet lever which performs the securing of the foot with the required force.

In practical use, therefore, the user, once the quarters have been brought together and the rewinding assembly has recovered part of the cable, continues to perform the alternate oscillation of the ratchet lever which, in practice, has the thrust lever pushing the rack plate while the retention lever blocks it in the position thus reached until the user achieves the required closing action.

In order to achieve the opening, it is sufficient to open the lever by rotating it upwards, so that the hook which keeps the rack plate blocked disengages from the plate itself, so that the latter, being free, slides upwards along the quarter, allowing a slackening of the cable with a consequent mutual opening of the quarters.

As already mentioned previously, the opening of the quarters can be further increased also by acting on the button 60 which allows the quick unwinding of a significant amount of cable.

From what has been described, it can thus be seen that the invention achieves the intended aim and objects, and in particular the fact is stressed that a device for closing quarters of ski boots is provided which entails the use of a single lever which can be operated with a downward pushing motion, which allows to achieve a gradual closing securing action between the quarters.

Furthermore, the component elements of the closing device never separate and therefore, when the user needs to perform the closure, he need not couple any elements to each other beforehand, but it is sufficient for him to act with an alternate oscillation on the ratcheting lever 1, until the required securing action is achieved.

In practice, the materials employed, so long as compatible with the specific use, as well as the dimensions and the contingent shapes, may be any according to the requirements.

We claim:

1. A cable actuation device particularly for ski boots, comprising at least one base member, at least one plate-like member, at least one actuation element, ratchet pawl means, and at least one cable having at least one cable portion and at least one other cable portion, said base member being fixable to a ski boot portion, said actuation element being movably associated with said base member and adapted for effecting alternate actuation movement with respect to said base member, said plate-like member being slidably associated with said base member, said at least one cable portion being operatively connected to said plate-like member, said at least one other cable portion being adapted for attachment to at least one other ski boot portion, said ratchet pawl means being associated with said actuation element and cooperating with said plate-like member for converting said alternate actuation movement of said actuation element into successive sliding movement of said plate-like member with respect to said base member.

2. A cable actuation device according to claim 1, wherein said plate-like member comprises at least one rack plate, said rack plate having defined thereon a plurality of teeth, said ratchet pawl means successively engaging said plurality of teeth upon said alternate actuation movement of said actuation element.

3. A cable actuation device according to claim 2, wherein said actuation element comprises at least one actuation lever, said actuation lever being journalled to said base member at a connection point, said rack plate being slidably accommodated between said base member and said connection point.

4. A cable actuation device according to claim 1, wherein said at least one cable portion comprises an intermediate portion of said cable, and wherein said at least one other cable portion comprises at least one cable end and at least one other cable end, said intermediate portion of said cable being fixed to said plate-like member, said at least one cable and and said at least one other cable end being fixable to at least one other ski boot portion.

5. A cable actuation device according to claim 1, wherein said actuation element comprises an actuation lever and wherein said plate-like member comprises at least one rack plate, said rack plate being slidable with respect to base member in at least a cable tightening direction and at least a cable slackening direction, said ratchet pawl means comprising at least one retention lever and at least one thrust lever, said thrust lever being journalled to said actuation lever and releasably engageable with said rack plate for causing successive sliding movements of said rack plate with respect to said base member in said cable tightening direction upon alternate actuation movements of said actuation lever, said retention lever being journalled to said actuation lever and releasably engaging with said rack plate for preventing movement of said rack plate with respect to said base member in said cable slackening direction.

6. A cable actuation device according to claim 5, wherein said actuation lever is movable to an opening position, and wherein said thrust lever and said retention lever are both adapted to disengage from said rack plate upon said lever being moved to said opening position.

7. A cable actuation device according to claim 5, wherein said actuation lever is journalled to said base member at a connection point, said retention lever being journalled to said actuation lever at said connection point.

8. A cable actuation device according to claim 5, wherein said retention lever defines a retention lever length, and wherein said thrust lever defines a thrust lever length, said thrust lever length being greater than said retention lever length.

9. A cable actuation device according to claim 5, wherein said actuation lever is journalled to said base member at a connection point, said retention lever being journalled to said actuation lever at said connection point, said thrust lever being journalled to said actuation lever at a second connection point, said actuation lever having a length dimension, between said second connection point and said connection point there being defined a spacing extension, said length dimension being at least four times greater than said spacing extension.

10. A cable actuation device according to claim 5, further comprising first spring means and second spring means, said first spring means being interposed between said retention lever and said actuation lever and adapted for biasing said retention lever into engagement with said rack plate, said second spring means being interposed between said thrust lever and said actuation lever and adapted for biasing said thrust lever into engagement with said rack plate.

11. A cable actuation device according to claim 1, further comprising a cable rewinding assembly, said at least one cable portion comprising an intermediate portion of said cable, said at least one other cable portion comprising at least one portion and at least one other cable end portion, said intermediate portion of said cable being fixed to said plate-like member, said cable rewinding assembly being adapted for releasably automatically rewinding said cable end portion and said other cable end portion.

12. A cable actuation device according to claim 11, wherein said cable rewinding assembly comprises a box-like body, at least one spool, and at least one rewinding spring having at least one spring end and at least one other spring end, and releasable spool retention means, said spool being rotatably mounted in said box-like body, said rewinding spring end being attached to said box-like body, said other spring end being attached to said spool, said rewinding spring being adapted for causing said spool to automatically rewind said cable end portion and said other cable end portion, said releasable spool retention means being adapted for temporarily preventing rotation of said spool with respect to said box-like body.

13. A device for closing quarters according to claim 5, further comprising first spring means and second spring means, said first spring means being interposed between said retention lever and said actuation lever and adapted for biasing said retention lever into engagement with said rack plate, said second spring means being interposed between said thrust lever and said actuation lever and adapted for biasing said thrust lever into engagement with said rack plate.

14. A device for closing quarters, particularly for rear entry ski boots, comprising at least one base member, at least one plate-like member, at least one actuation lever, ratchet pawl means, and at least one cable having at least one cable portion and at least one other cable portion, said base member being fixable to a ski boot portion, said actuation lever being movably associated with said base member and adapted for effecting alternate oscillating actuation movement with respect to said base member, said plate-like member being slidably associated with said base member, said at least one cable portion being operatively connected to said plate-like member, said at least one other cable portion being adapted for attachment to at least one other ski boot portion, said ratchet pawl means being associated with said actuation lever and adapted for converting said alternate oscillating actuation movement of said actuation lever into substantially linear sliding movement of said plate-like member with respect to said base member.

15. A device for closing quarters according to claim 14, wherein said plate-like member comprises at least one rack plate, said rack plate having defined thereon a plurality of teeth, said ratchet pawl means successively engaging said plurality of teeth upon said alternate actuation movement of said actuation lever.

16. A device for closing quarters according to claim 15, wherein said actuation lever is journalled to said base member at a connection point, said rack plate being slidably accommodated between said base member and said connection point.

17. A device for closing quarters according to claim 14, wherein said plate-like member comprises at least one rack plate, said rack plate being slidable with respect to base member in at least a cable tightening direction and at least a cable slackening direction, said ratchet pawl means comprising at least one retention lever and at least one thrust lever, said thrust lever being journalled to said actuation lever and releasably engageable with said rack plate for causing successive sliding movements of said rack plate with respect to said base member in said cable tightening direction upon alternate actuation movements of said actuation lever, said retention lever being journalled to said actuation lever and releasably engaging with said rack plate for preventing movement of said rack plate with respect to said base member in said cable slackening direction.

18. A device for closing quarters according to claim 17, wherein said actuation lever is movable to an opening position, and wherein said thrust lever and said retention lever are both adapted to disengage from said rack plate upon said lever being moved to said opening position.

19. A device for closing quarters according to claim 17, wherein said actuation lever is journalled to said base member at a connection point, said retention lever being journalled to said actuation lever at said connection point.

20. A device for closing quarters according to claim 17, wherein said retention lever defines a retention lever length, and wherein said thrust lever defines a thrust lever length, said thrust lever length being greater than said retention lever length.

21. A device for closing quarters according to claim 17, wherein said actuation lever is journalled to said base member at a connection point, said retention lever being journalled to said actuation lever at said connection point, said thrust lever being journalled to said actuation lever at a second connection point, said actuation lever having a length dimension, between said second connection point and said connection point there being defined a spacing extension, said length dimension being at least four times greater than said spacing extension.

22. A device for closing quarters according to claim 14 further comprising a cable rewinding assembly, said at least one cable portion comprising an intermediate portion of said cable, said at least one other cable portion comprising at least one cable end portion and at least one other cable end portion, said intermediate portion of said cable being fixed to said plate-like member, said cable rewinding assembly being adapted for releasably automatically rewinding said cable end portion and said other cable end portion.

23. A device for closing quarters according to claim 22, wherein said cable rewinding assembly comprises a box-like body, at least one spool, and at least one rewinding spring having at least one spring end and at least one other spring end, and releasable spool retention means, said spool being rotatably mounted in said box-like body, said rewinding spring end being attached to said box-like body, said other spring end being attached to said spool, said rewinding spring being adapted for causing said spool to automatically rewind said cable end portion and said other cable end portion, said releasable spool retention means being adapted for temporarily preventing rotation of said spool with respect to said box-like body.

24. In combination, a device for closing quarters and a rear entry ski boot, said rear entry ski boot comprising a shell, at least one quarter and at least one other quarter, said one quarter and said other quarter being connected to said shell, at least said one quarter being articulated to said shell and movable with respect thereto, said device comprising at least one base member, at least one plate-like member, at least one actuation lever, ratchet pawl means, and at least one cable having at least one cable portion and at least one other cable portion, said base member being fixed to said at least one quarter, said actuation lever being movably associated with said base member and adapted for effecting alternate oscillating actuation movement with respect to said base member and said at least one quarter, said plate-like member being slidably connected to said base member, said at least one cable portion being operatively connected to said plate-like member, said at least one other cable portion being adapted for attachment to at least one other quarter, said ratchet pawl means being associated with said actuation lever and adapted for converting said alternate oscillating actuation movement of said actuation lever into substantially linear sliding movement of said plate-like member and said at least one cable portion with respect to said base member, for drawing said at least one other cable portion and said at least one other quarter towards said base member and said at least one quarter.

* * * * *